US005827076A

United States Patent [19]

Chen

[11] Patent Number: 5,827,076

[45] Date of Patent: Oct. 27, 1998

[54] TERMINATION PLATE FOR CONNECTOR

[75] Inventor: Ping Chen, Nagoya, Japan

[73] Assignee: The Whitaker Corporation, Wilmington, Del.

[21] Appl. No.: 659,735

[22] Filed: Jun. 6, 1996

[30] Foreign Application Priority Data

Jul. 25, 1995 [JP] Japan ..... 7-189038

[51] Int. Cl.[6] ..... H01R 9/09

[52] U.S. Cl. ..... 439/79; 439/590

[58] Field of Search ..... 439/79, 80, 590

[56] References Cited

U.S. PATENT DOCUMENTS 4,056,300 11/1977 Schumacher ..... 439/78
5,080,596 1/1992 Viselli et al. ..... 439/79
5,370,540 12/1994 Kobayashi ..... 439/78
5,441,425 8/1995 Kitamura ..... 439/620

*Primary Examiner*—Neil Abrams
*Assistant Examiner*—T. C. Patel
*Attorney, Agent, or Firm*—Bradley N. Ditty

[57] ABSTRACT

To provide a termination plate preventing the soldered connections of the termination sections of contacts from cracking even when external forces are applied to the contacts of a connector mounted to a printed circuit board. Slots (54, 56, 58, 60, 62) are provided in a termination plate (50) of a connector (10). The termination plate (50) has multiple through holes (52) for insertion of termination sections (22) of contacts (20) arranged in three rows parallel to the length of the housing length. Through holes (52) of one row are connected in groups of two or more by the slots (54, 56, 58, 60, 62) extending parallel to the length of the housing.

6 Claims, 3 Drawing Sheets

TERMINATION PLATE FOR CONNECTOR

FIELD OF THE INVENTION

This invention relates to connectors with termination plates intended for mounting on printed circuit boards.

BACKGROUND OF THE INVENTION

Electric connectors intended for mounting on printed circuit boards (PCB) are widely used for connections of PCBs with electrical circuits. These electrical connectors include contacts having termination sections which are inserted in through holes in a printed circuit board and contact sections intended to form connection with the contacts of mating connectors, and a housing in which these contacts are arranged. The contacts are usually made by punching from a thin metal sheet with subsequent bending. Since the termination sections extend from the housing, they can be easily bent during transportation and handling. If a termination section is bent out of alignment, its insertion in a corresponding through hole becomes difficult.

In order to prevent such an occurrence, to arrange the termination sections in a desired pattern and to assure an accurate insertion of the termination sections in the through holes in the printed circuit board, the use of termination plates was proposed. In accordance with such proposal, termination sections are passed through the through holes provided in a termination plate. Electrical connectors equipped with such termination plates are defined as connectors with termination plates.

Below, an explanation concerning a conventional connector with a termination plate with reference to FIGS. 5, 5A and 6 is provided.

Connector 10 includes electrically-conducting contacts 10, an insulating housing 30 and an insulating termination plate 40.

Contacts 20 are made from thin metal material by stamping and bending. They have termination sections 22 intended for the insertion in the through holes in a printed circuit board (not shown in the drawing) and contact sections 24 intended for connection with contacts of a mating connector (not shown in the drawing). In the termination plate 40, through holes 42 are provided for the insertion of termination sections 22. By placing the termination sections 22 along the through holes 42, it is possible to arrange them in a desired pattern, to prevent termination sections 22 from bending and to assure accurate insertion of the termination sections 22 in the through holes of the printed circuit board.

As was mentioned above, through holes 42 of the termination plate 40 are utilized to prevent termination sections 22 from bending and to arrange them in the desired pattern. Therefore, the diameter of through holes 42 is slightly larger than the thickness of the termination sections 22. As the result, the portions of the contacts determining their position within the through holes have a limitation regarding the movement in the direction of the through hole diameter, that is, it becomes fixed in the direction of the through hole diameter. Termination sections 22 are inserted in the through holes of the printed circuit board and secured to the board by means of soldering. Therefore, the contacts of a connector with termination plate mounted on a printed circuit board are restrained at two points: at the printed circuit board and at the termination plate.

However, the printed circuit board and termination plate are usually made of two different plastic materials having, as a rule, different coefficients of thermal expansion. When, during the soldering of the termination sections to the printed circuit board, the printed circuit board and the termination plate are heated, or when the connector with termination plate mounted on a printed circuit board is placed in a medium having an elevated temperature, the degrees of thermal expansion of the termination plate and the printed circuit board are different. This results in external forces applied to the portions of the contacts secured in the printed circuit board and to the portions secured in the termination plate to be vectored in different directions. If the forces generated under these conditions exceed the strength of the solder, it can crack, which can effect the reliability of the electrical connections between the termination sections and the printed circuit board. This problem is especially noticeable in connectors with elongated termination plates.

Considering the above mentioned circumstances, the purpose of this invention is to offer a termination plate and a connector with a termination plate which prevents the cracking of the solder securing the termination sections to the printed circuit board even if external forces are applied to the contacts of the connector with termination plate mounted on a printed circuit board.

SUMMARY OF THE INVENTION

In order to achieve the purposes stated above, a first termination plate according to this invention is used on a connector with a termination plate having multiple contacts including termination sections intended for the insertion into through holes of a printed circuit board and contact sections intended to form connection with corresponding contacts of a mating connector, and a housing in which the multiple contacts are arrayed, wherein the termination plate has multiple through holes for the insertion and arrangement of termination sections of the multiple contacts, and the termination plate has slots connecting together at least two of the multiple through holes.

Also in order to achieve the purposes stated above, a second termination plate according to this invention is used on a connector having multiple contacts including termination sections intended for insertion into through holes of a printed circuit board and contact sections intended to connect with corresponding contacts of a mating connector, and a housing in which the multiple contacts are arrayed, wherein the termination plate has multiple through holes for the insertion and arrangement of termination sections of the multiple contacts, and the termination plate has first slots extending along the width of the termination plate from one edge toward the other, second slots extending along the width of the termination plate from the other edge to the first edge and offset in a lengthwise direction to a certain distance relative to the first slots, and third slots located between the front end of the first slots and the front end of the second slots and oriented in such a manner that they cross the width direction.

Also in order to achieve the purposes stated above, the first connector with a termination plate according to this invention has multiple contacts including termination sections intended for insertion into through holes of a printed circuit board and contact sections intended to connect with corresponding contacts of a mating connector, a housing in which the multiple contacts are arrayed in at least one lengthwise oriented row, and a termination plate for insertion and arrangement of the termination sections of the multiple contacts having at least one row of through holes made in the same pattern as the termination sections of the multiple contacts, and wherein the termination plate has slots formed in a lengthwise direction which connect at least two through holes.

Also in order to achieve the purposes stated above, the second connector according to this invention with a termination plate having multiple contacts including termination sections intended for insertion into through holes of a printed circuit board and contact sections intended to connect with corresponding contacts of a mating connector, a housing in which the multiple contacts are arrayed, and a termination plate having through holes into which the termination sections are inserted and arrayed, and the termination plate has first slots extending from one edge of the plate toward the other edge along the width of the termination plate, second slots extending from the other edge of the plate toward the first edge and offset relative to the first slots by a certain distance in a lengthwise direction, and third slots extending obliquely between the end of the first slots and the end of the second slots.

BRIEF DESCRIPTION OF THE DRAWINGS

Embodiments of the invention will now be described by way of example with reference to the accompanying drawings in which.

DETAILED DESCRIPTION OF THE INVENTION

Figure 1:
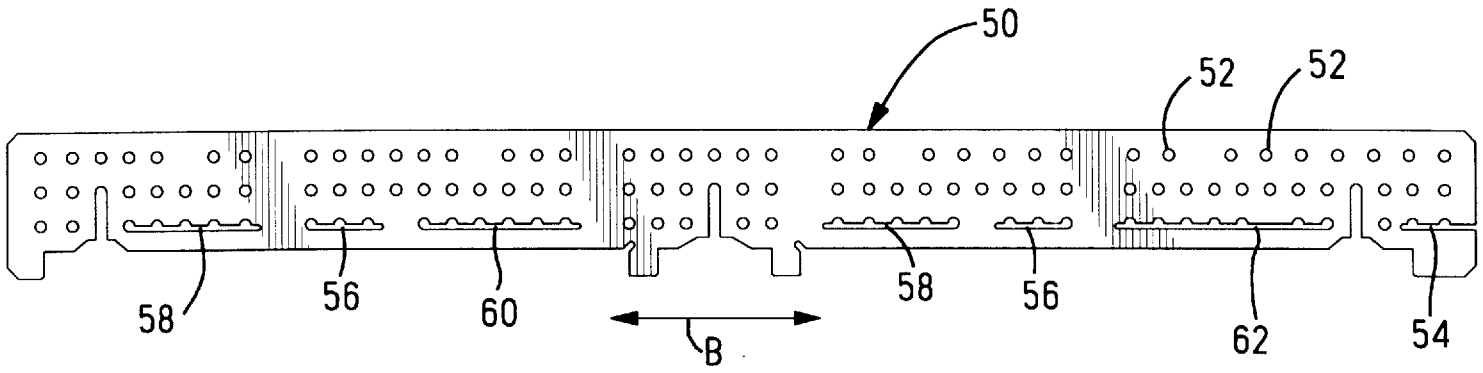
FIG. 1 is a top plan view of a termination plate according to this invention.
Figure 5:
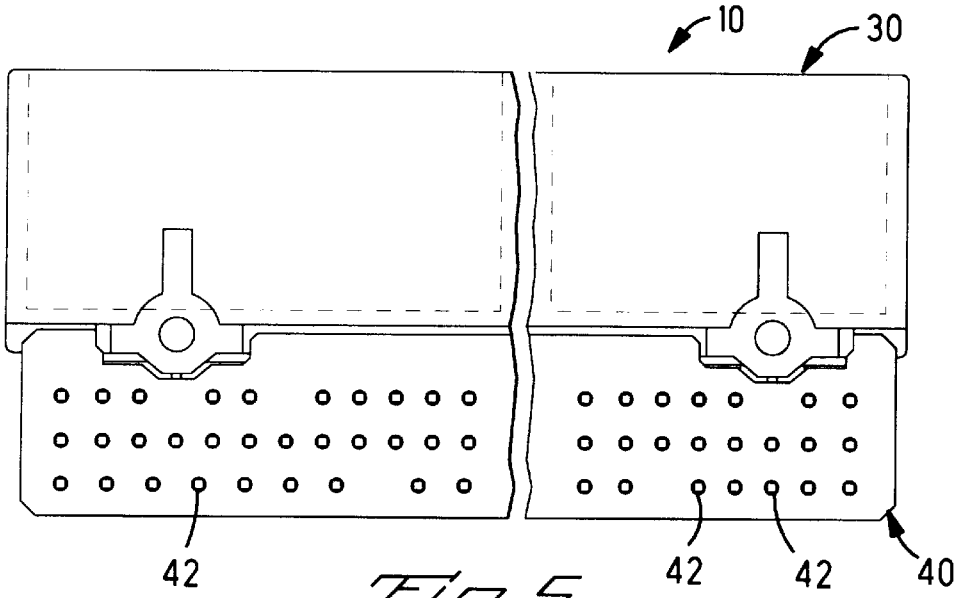
FIG. 5 is a bottom view of a conventional connector with termination plate.
Figure 5A:
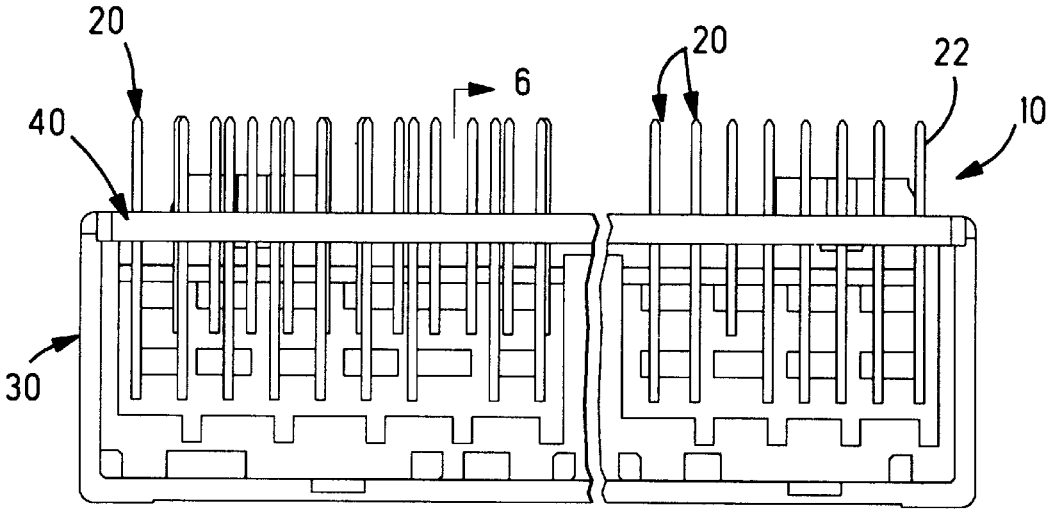
FIG. 5A is a rear view of the connector of FIG. 5 with contacts.

The termination plate according to this invention shown in FIG. 1 includes electrically conductive contacts (not shown in the drawing), an insulating housing (not shown in the drawing) and an insulating termination plate 50. With the exception of the termination plate, all other components are almost the same as similar components of the conventional connector with termination plate shown in FIG. 5. Therefore, these components were omitted from the drawing for purposes of simplicity. The termination plate and the printed circuit board to which the connector with termination plate is mounted are made of different types of plastic material having different coefficients of thermal expansion.

Figure 6:
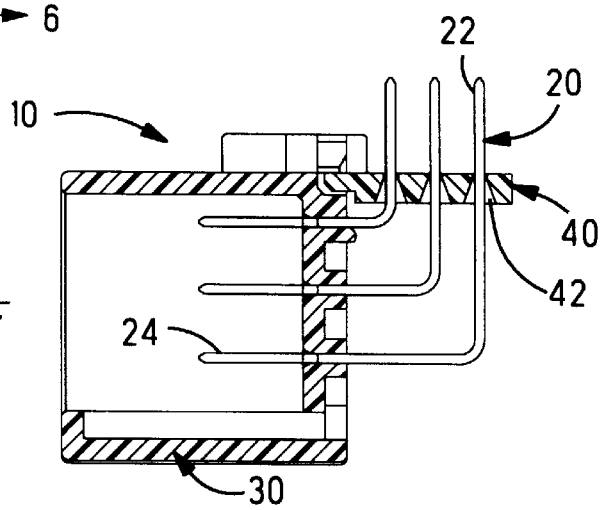
FIG. 6 is a cross-sectional view taken along line 6—6 of FIG. 5A.

As shown in FIG. 1, termination plate 50 according to this invention has multiple through holes 52 arranged in three rows running parallel to the long side (shown by arrow B) of the housing (not shown in the drawing) through which termination sections of the contacts (not shown in the drawing) pass. In one row out of these three rows of the through holes, slots 54, 56, 58, 60, 62 are disposed connecting at least two through holes. The side of the termination plate 50 in which these slots 54, 56, 58, 60, 62 are located is connected to the housing. As can be seen from FIG. 6, the termination sections 22 of the contacts inserted in the through holes 52 forming slots 54, 56, 58, 60, 62 have a shorter length than the termination sections 22 inserted in the through holes of the other rows. Slots 54, 56, 58, 60, 62 connect respectively two, three, five, six and seven through holes 52. The width of each slot is 0.5 mm. The diameter of through holes 52 is 1.0 mm, so slots 54, 56, 58, 60, 62 connect halves of through holes 52. Therefore, the fact that through holes 52 are connected by slots 54, 56, 58, 60, 62 does not affect their function of arranging the contact termination sections.

Now, let it be assumed that the temperature of the medium in which the printed circuit board having a connector with termination plate 50 mounted on it is operated has increased.

As was mentioned above, coefficients of thermal expansion of the plastic materials of the printed circuit board and the termination plate are different. Therefore, during the expansion of the printed circuit board and the termination plate, the difference in their thermal expansion rates will result in external forces applied to the portions of the contacts secured in the printed circuit board and the portions located in the through holes 52. These forces will apply to the portions in different directions. As has been mentioned above, through holes connected by slots 54, 56, 58, 60, 62 accommodate contacts whose termination sections 22 are shorter than that of the contacts inserted in the through holes of other rows. Since these sections are short, the effect of external forces on them is stronger than on the other contacts having longer termination sections, and there is only little room to compensate for the external forces. However, since slots 54, 56, 58, 60, 62 are provided in the termination plate 50, the termination sections of the contacts located in the through holes 52 can move inside the slots 54, 56, 58, 60, 62 if external forces are applied to the contacts. Therefore, the movement associated with the expansion of the printed circuit board becomes easier, and the external forces acting on the termination sections of the contacts secured in the board are relieved. This causes relief of the stresses applied to the soldered connections of the termination sections, thereby preventing the soldered connections from cracking and increasing the reliability of the electrical connection between the termination sections and the printed circuit board.

Figure 2:
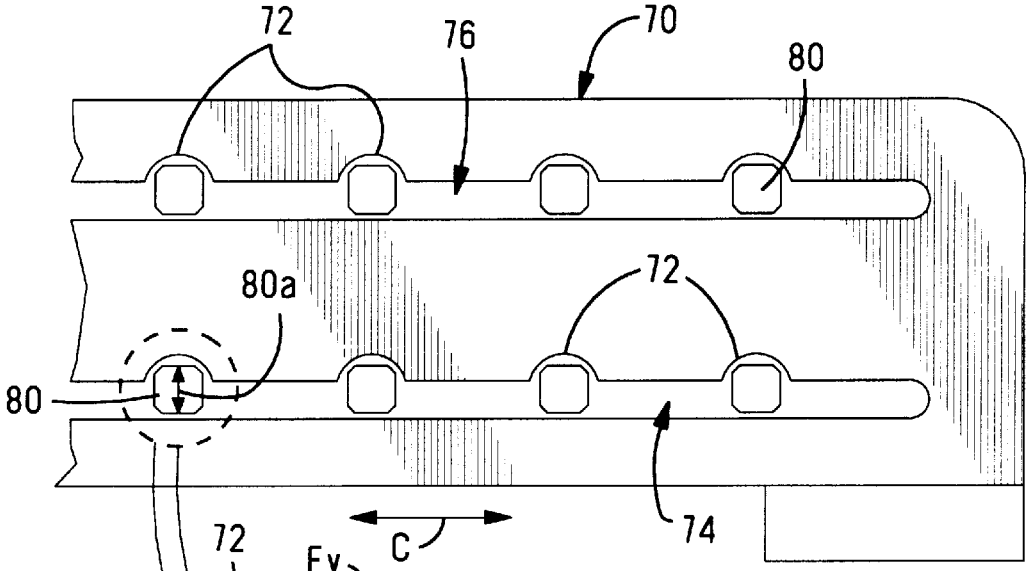
FIG. 2 is an enlarged part top plan view of an alternative termination plate.

FIG. 2 represents an enlarged plan view of another embodiment of a termination plate according to this invention.

Figure 2A:
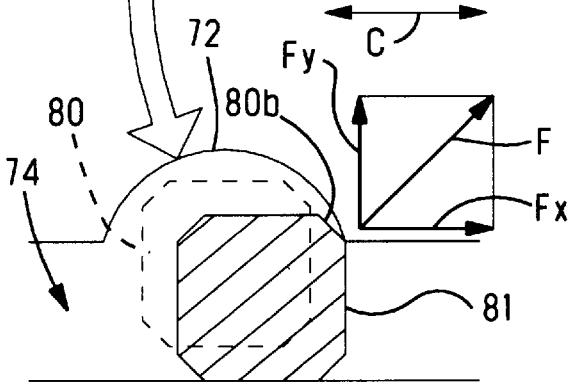
FIG. 2A is an enlargement of a section of the termination plate of FIG. 2.

Through holes 72 in termination plate 70 for the insertion of termination sections of contacts 80 are arranged in two rows running parallel to the long side (shown by arrow C) of the housing (not shown in the drawing). These two rows of through holes 72 are formed in the shape of slots 74, 76 connecting the through holes and located parallel to the long side of the housing. The width of slots 74, 76 is slightly narrower than the thickness 80*a* of contacts 80, and corners 80*b* of contacts 80 are tapered. If, due to the difference in thermal expansion of the printed circuit board (not shown in the drawing) and the termination plate 70, the contact is shifted from its original position 80 (shown by the dotted line in FIG. 2A) to a new position 81 (shown by the hatched square). In such a case, because corners 80*b* of the contact 80 are tapered, it can move in slot 74, thus relieving the external forces thereon. The reaction F in termination plate 70 produced by the external force is divided into components $F_x$ and $F_y$.

While in the termination plate 50 shown in FIG. 1 only a part of the through holes 52 are connected by slots, all the through holes 72 in termination plate 70 shown in FIG. 2 are connected by slots 74, 76 parallel to the housing. This makes it possible to relieve even more of the external forces generated between the portions of the contacts secured in the printed circuit board and the portions located inside the through holes of the termination plate.

In these two examples described above, slots connecting through holes are parallel to the long side of the housing. However, it is also possible to provide slots running parallel or obliquely relative to the short side of the housing. This makes it possible for the portions of the contacts located inside through holes to move, thus easing the external forces acting upon the portions of the contacts secured in the printed circuit board. This results in also relieving the stress arising in the soldered connections which makes it possible to prevent them from cracking, thereby increasing reliability of electrical connections between termination sections of the contacts and circuitry on the printed circuit board.

Figure 3:
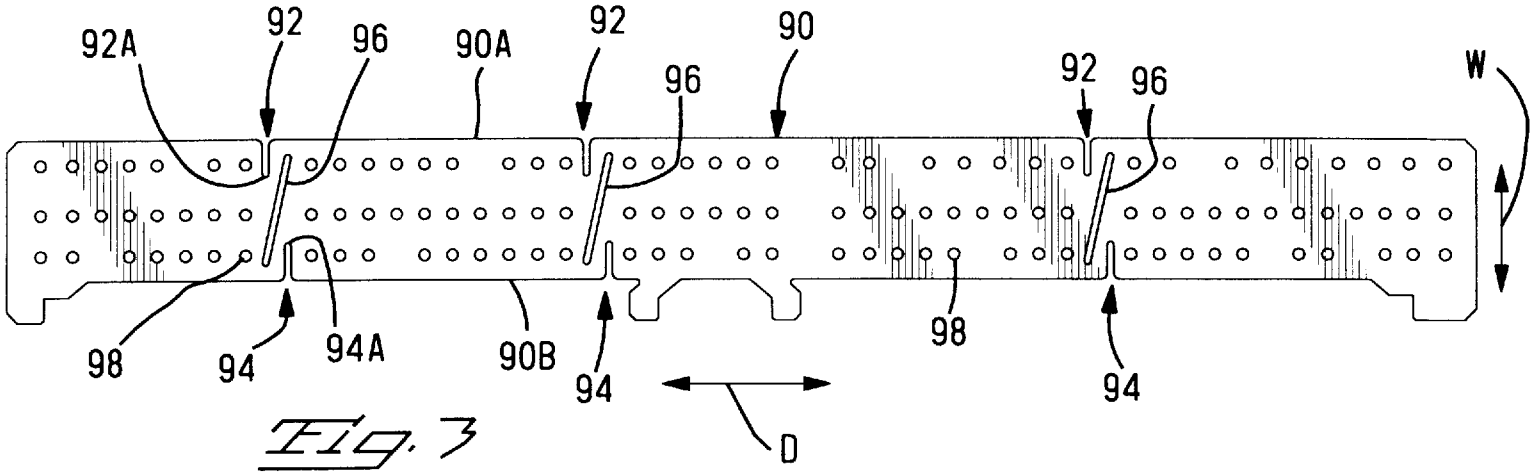
FIG. 3 is a top plan view of another alternative termination plate.

FIG. 3 represents a plan view of another embodiment of the termination plate according to this invention. Since the housing and contacts of this connector are almost the same as those of the conventional connector with termination plate depicted in FIG. 5, they are not shown in this drawing for purposes of simplicity.

A specific feature of termination plate 90 for the connector is that it has three types of slots in it, namely: the first-type slots 92, the second-type slots 94 and the third-type slots 96. Slots 92 of the first type are located in the direction of the width of the termination plate 90 (the direction shown by arrow W) and are located along edge 90A of the termination plate 90 and extend toward the edge 90B. Slots 94 of the second type are located across the termination plate 90 along edge 90B and extend toward edge 90A, and they are offset relative to slots 92 by certain intervals in the lengthwise direction (shown by arrow D). The reason for the offsetting of slots 92 relative to slots 94 in the lengthwise direction (shown by arrow D) is not to compromise the strength of the termination plate 90. Slots 96 of the third type are located between an end 92A of slots 92 and an end 94A of slots 94, and they extend in an angular or oblique direction crossing the width of the termination plate. Altogether, there are three groups of such slots in the termination plate 90, each in the form of first type slots 92, second type slots 94 and third type slots 96. There is also a number of through holes 98 in the termination plate 90 for the insertion of termination sections 22 of contacts 20 (see FIG. 6). None of the through holes 98 is connected to the slots 92, 94 or 96.

If a connector with termination plate 90 described above mounted on a printed circuit board is exposed to an elevated temperature, it undergoes the same stresses as those explained above with respect to the termination plate 50 shown in FIG. 1. Namely, heating causes uneven thermal expansion of the printed circuit board and the termination plate resulting in external forces applied in different directions to the portions of the contacts secured in the printed circuit board and the portions inside through holes 98. However, the expansion of the termination plate is compensated (especially in the lengthwise direction) by the contraction of the slots 92, 94, 96, thus relieving the action of the external forces on the contacts. As a result, the action of the external forces on the soldered connections of the termination sections is also relieved which makes it possible to prevent the appearance of cracks in the soldering and to increase the reliability of electrical connections between termination sections and circuitry on the printed circuit board.

Figure 4A:
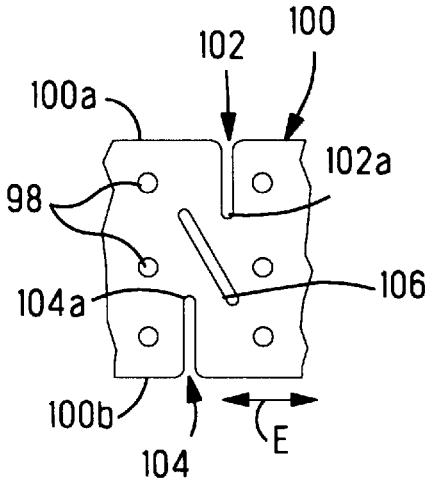
FIG. 4A is a part top plan view of a further alternative termination plate.
Figure 4B:
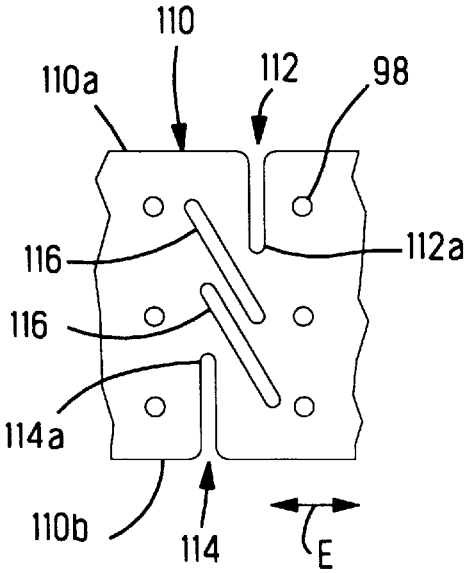
FIG. 4B is a part top plan view of an additional alternative termination plate.

FIGS. 4A and 4B depict modified slots.

In the termination plate 100 shown in FIG. 4A, the following slots are located: a first slot 102 extends from edge 100*a* in the direction of width (shown by arrow E) toward the other edge 100*b*, a second slot 104 extends from the edge 100*b* toward the edge 100*a*, and a third slot 106 is located between the end 102*a* of the first slot 102 and the end 104*a* of the slot 104 slanted toward the right and down direction. Slots 102, 104, 106 have configurations similar to the slots 92, 94, 96 of the termination plate 90 in that they relieve the external forces applied to soldered connections of the termination sections, thereby preventing the occurrence of cracks in the soldered connections.

In the termination plate 110 shown in FIG. 4B, the following slots are located: a first slot 112 extending from edge 110*a* in the direction of width (shown by arrow E) toward the other edge 110*b*, a second slot 114 extending from edge 100*b* toward edge 110*a*, and two third slots 116 located between the end 112*a* of the slot 112 and the end 114*a* of the slot 114 slanted toward the right and down direction. Slots 112, 114, 116 have a configuration similar to the slots described above in conjunction with FIG. 4A, that is they relieve the external forces applied to soldered connections of the termination sections, thereby preventing the occurrence of cracks in the soldered connections.

As is evident from the above explanations, the first termination plate according to this invention has slots connecting at least two through holes. Therefore, when external forces are applied in different directions to the portions of the contacts secured on the printed circuit board and to the portions located within through holes of the termination plate, the portions of the contacts located within the through holes of the termination plate can move within the slots, thereby relieving the external forces applied to the portions affixed to the printed circuit board. As a result, the external forces applied to the soldered connections of the termination sections are relieved which prevent them from cracking, thereby improving the reliability of the electrical connections of the termination sections with the circuitry on the printed circuit board.

The second termination plate according to this invention makes it possible to compensate for the expansion of the termination plate, especially in the lengthwise direction, due to the presence of the first, second and third slots which contract during expansion, resulting in the relief of the external forces applied to the contacts. As a result, the external forces applied to the soldered connections of the termination sections are relieved which prevent them from cracking, thereby improving the reliability of the electrical connections of the termination sections with the circuitry on the printed circuit board.

The first connector with termination plate according to this invention has slots connecting at least two through holes which are parallel to the lengthwise direction. Therefore, when external forces are applied in different directions to the portions of the contacts secured on the printed circuit board and to the portions located within through holes of the termination plate, the portions of the contacts located within the through holes of the termination plate can move inside the slots, thereby relieving the external forces applied to the portions affixed to the printed circuit board. As a result, the external forces applied to the soldered connections of the termination sections are relieved which prevents them from cracking, thereby improving the reliability of the electrical connections of the termination sections with the circuitry on the printed circuit board. Since in the connector with termination plate according to this invention, the termination plate has slots connecting at least two through holes which are made in the lengthwise direction, this invention is especially effective for the connectors having a long termination plate.

The termination plate of the second connector according to this invention has first, second and third slots in it. These slots make it possible to compensate for the expansion of the termination plate, especially in the lengthwise direction. The expansion is compensated due to the contraction of the slots, thereby relieving the external forces acting on the contacts. As a result, the external forces applied to the soldered connections of the termination section are relieved which prevent them from cracking, thereby improving the reliability of the electrical connections of the termination sections with the circuitry on the printed circuit board.

I claim:

1. A termination plate for use on an electrical connector having a housing in which electrical contacts having contact sections and termination sections are secured, the termination sections adapted to be connected to conductive areas on a circuit board, the termination plate comprising:

an elongated dielectric member having rows of through holes extending therealong at spaced intervals through which the termination sections extend; and first slots in said dielectric member at different locations therealong, the first slots extending along an inner edge of said dielectric member connecting together at least two through holes, second slots in said dielectric member at spaced locations extending inwardly from the inner edge, the first and second slots providing compensation when the termination plate with termination sections of the contacts are disposed therein and the circuit board is subjected to temperature variations thereby preventing soldered connections of the termination sections to the conductive areas from cracking and disrupting such connections.

2. A termination plate as claimed in claim 1, wherein the slots connect together from two to seven through holes.

3. A termination plate for use on an electrical connector having a housing in which electrical contacts having contact sections and termination sections are secured, the termination sections adapted to be connected to conductive areas on a circuit board, the termination plate comprising:

an elongated dielectric member having rows of through holes extending therealong at spaced intervals through which the termination sections extend; and slots in said dielectric member at different locations therealong comprising first slots, second slots and third slots, said first slots extending inwardly from an outer edge of said dielectric member at spaced intervals therealong, said second slots extending inwardly from an inner edge of said dielectric member at spaced intervals therealong opposite the first slots, said third slots, extending obliquely across substantially the width of the dielectric member between the opposed first slots and second slots, the slots providing compensation when the termination plate with the termination sections of the contacts disposed therein and the circuit board are subjected to temperature variations thereby preventing soldered connections of the termination sections to the conductive areas from cracking and disrupting such connections.

4. A termination plate as claimed in claim 3, wherein the first slots are offset relative to the second slots.

5. A termination plate as claimed in claim 3, wherein the third slots comprise a single oblique slot between the opposed first and second slots.

6. A termination plate as claimed in claim 3, wherein the third slots comprise a pair of parallel oblique slots between the opposed first and second slots.

* * * * *